US009163833B2

(12) United States Patent
Gibowski et al.

(10) Patent No.: US 9,163,833 B2
(45) Date of Patent: Oct. 20, 2015

(54) REDUCED WEAR AND SELF CLEANING STOKER SEAL

(75) Inventors: Steven R. Gibowski, Pensacola, FL (US); Ivan Semyanko, East Granby, CT (US); Israel Caban, Wilbraham, MA (US); Jeffrey Zak, Glastonbury, CT (US)

(73) Assignee: ALSTOM Technology Ltd, Baden (CH)

( * ) Notice: Subject to any disclaimer, the term of this patent is extended or adjusted under 35 U.S.C. 154(b) by 798 days.

(21) Appl. No.: 12/916,983

(22) Filed: Nov. 1, 2010

(65) Prior Publication Data

US 2012/0103236 A1 May 3, 2012

(51) Int. Cl.

| | |
|---|---|
| ***F23H 11/10*** | (2006.01) |
| ***F23H 11/18*** | (2006.01) |
| *F23H 11/24* | (2006.01) |
| *F23H 15/00* | (2006.01) |

(52) U.S. Cl.
CPC ..... *F23H 11/18* (2013.01); *F23H 11/24* (2013.01); *F23H 15/00* (2013.01)

(58) Field of Classification Search
CPC ..... F23H 11/24; F23H 15/00
USPC ..... 110/267, 268, 269, 271, 272
See application file for complete search history.

(56) References Cited

U.S. PATENT DOCUMENTS

| | | | | |
|---|---|---|---|---|
| 1,660,217 | A * | 2/1928 | Bennis | 110/329 |
| 2,806,439 | A * | 9/1957 | Wagner | 110/282 |
| 3,665,668 | A * | 5/1972 | Maddan, Jr. | 52/275 |
| 8,070,004 | B2 * | 12/2011 | Williams et al. | 220/1.5 |

* cited by examiner

*Primary Examiner* — Kenneth Rinehart
*Assistant Examiner* — Gajanan M Prabhu

(57) ABSTRACT

A sealing apparatus (22) for use with a traveling grate (18) including a base (44) and one or more legs (42) extending upwardly from the base (44). The sealing apparatus (22) includes at least one flange (52) extending outwardly from one or more of the legs (42). The flange (52) includes a surface (53) extending between the leg (52) and one or more edges (52A, 52B, 52L) of the flange (52). The surface (53) includes a sealing portion (55) adjacent to the leg (52) and one or more discharge portions (56) sloped downwardly from the sealing portion (55) to one or more of the edges (52A, 52B, 52L), for discharge of wear materials therefrom. The sealing portion (55) is positioned proximate to a portion of the traveling grate (18) and defines a gap (G2) therebetween. The gap (G2) is configured to mitigate flow therethrough.

13 Claims, 4 Drawing Sheets

REDUCED WEAR AND SELF CLEANING STOKER SEAL

TECHNICAL FIELD

The present disclosure relates generally to a seal for sealing a gap between stationary and moving portions of a traveling grate stoker, and more particularly, to a seal configured for reduced wear and self-cleaning.

BACKGROUND OF THE INVENTION

Stokers can be used to feed a fuel such as coal or biomass to and/or through a furnace for combustion on a traveling grate in an interior area of the furnace. Combustion of the fuel creates heat, pressure and combustion byproducts such as ash in the interior area of the furnace. The stokers generally include a stationary base secured to the floor beneath the furnace. Typical stokers include a seal defined by a sealing portion of the base which sealingly engages a plurality of plates that move with the traveling grate, for example on a chain conveyor system. The purpose of the seal is to ensure that a proper amount of air passes into the furnace to aid in the combustion of the fuel on the plurality of plates. Improper amounts of air can cause non-uniform combustion of the fuel and create hot spots, causing deterioration and premature failure of the plurality of plates that move with the traveling grate.

Moreover, the seal is subject to mechanical wear because the plates move relative to the sealing portion of the base. In addition, the combustion byproducts are typically abrasive and can migrate into the seal. The abrasiveness of the combustion byproducts can accelerate wear of the seal, which will increase the gap through which an improper amount of combustion air can enter the furnace.

SUMMARY OF THE INVENTION

According to aspects illustrated herein, there is provided a sealing apparatus for use with a traveling grate stoker used for the delivery of fuel to an interior area of a boiler for combustion. The sealing apparatus includes a base and one or more legs extending upwardly from the base. The sealing apparatus also includes at least one flange extending outwardly from one or more of the legs. The flange includes a surface extending between the leg and one or more edges of the flange. The surface includes a sealing portion adjacent to the leg and one or more discharge portions sloped downwardly from the sealing portion to one or more of the edges, for a self cleaning discharge of wear materials therefrom. The sealing portion is positioned proximate to a portion of the traveling grate and defines a gap therebetween. The gap is configured to mitigate flow therethrough. The seal is useful in preventing abrasive combustion byproducts from entering into and mitigating wear between the flange and the portion of the traveling grate.

According to other aspects illustrated herein, each of the legs includes an extension projecting from an end thereof. Each of the extensions defines an outwardly facing side sealing surface. Each of the side sealing surfaces are positioned proximate to an edge of the travelling grate and define another gap therebetween, which is configured to mitigate flow therethrough.

According to other aspects illustrated herein, a portion of the traveling grate defines an upwardly facing conveying surface and each of the at least one legs includes an extension projecting from an end thereof. Each of the extensions has an edge, which is approximately flush with the conveying surface. The extensions serve as a dam to prevent byproducts from entering the gap between the sealing portion of the flange and a portion of the traveling grate.

According to other aspects illustrated herein, one of the discharge portions is a side-discharge portion that is sloped downwardly from the sealing portion to a lateral edge of the flange. The side-discharge portion is configured for self cleaning of combustion byproducts therefrom.

According to other aspects illustrated herein, another one or more of the discharge portions is an end-discharge portion that is sloped downwardly from the sealing portion to a distal end of the flange. The end-discharge portion is configured for self cleaning of combustion byproducts therefrom and also prevents carryover of the byproducts from one flange to another downstream flange.

According to other aspects illustrated herein, one or more gusset members are disposed between the legs and the base. A portion of the gusset member extends from the base to a position below a conveying surface of the traveling grate and serves as a support member between the legs.

The above described and other features are illustrated by the following figures and detailed description.

BRIEF DESCRIPTION OF THE DRAWINGS

Referring now to the Figures, which are exemplary embodiments, and wherein the like elements are numbered alike.

DETAILED DESCRIPTION OF PREFERRED EMBODIMENTS

Figure 1:
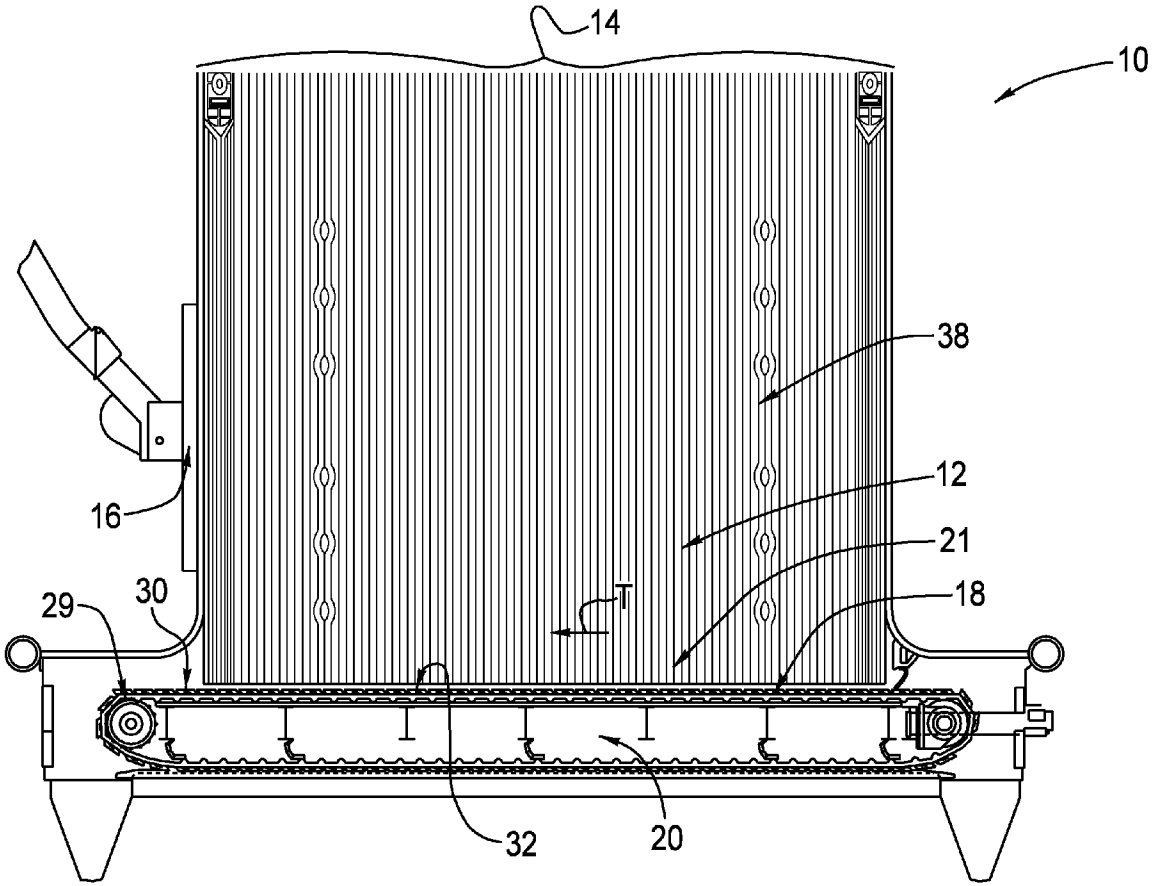
FIG. 1 is a side view of a stoker fired boiler with a traveling grate stoker.

As shown in FIG. 1 a stoker fired boiler 10 includes an interior area 12 defined by a plurality of water wall tubes 14 having external portions thereof connected to one another. The boiler 10 includes multiple fuel inlets 16 for conveying fuel such as coal or biomass into the interior area 12 for combustion therein. The boiler 10 also includes a traveling grate stoker 18 disposed in a bottom portion 21 of the boiler and mounted to a foundation underneath the boiler. The traveling grate stoker 18 conveys fuel on a conveying surface 32 of the traveling grate stoker. The traveling grate stoker 18 also regulates the flow of air from an undergrate portion 20 of the boiler 10 thereby ensuring that a sufficient amount of the air is available for combustion of the fuel in the boiler and on the traveling grate surface 32.

Figure 2:
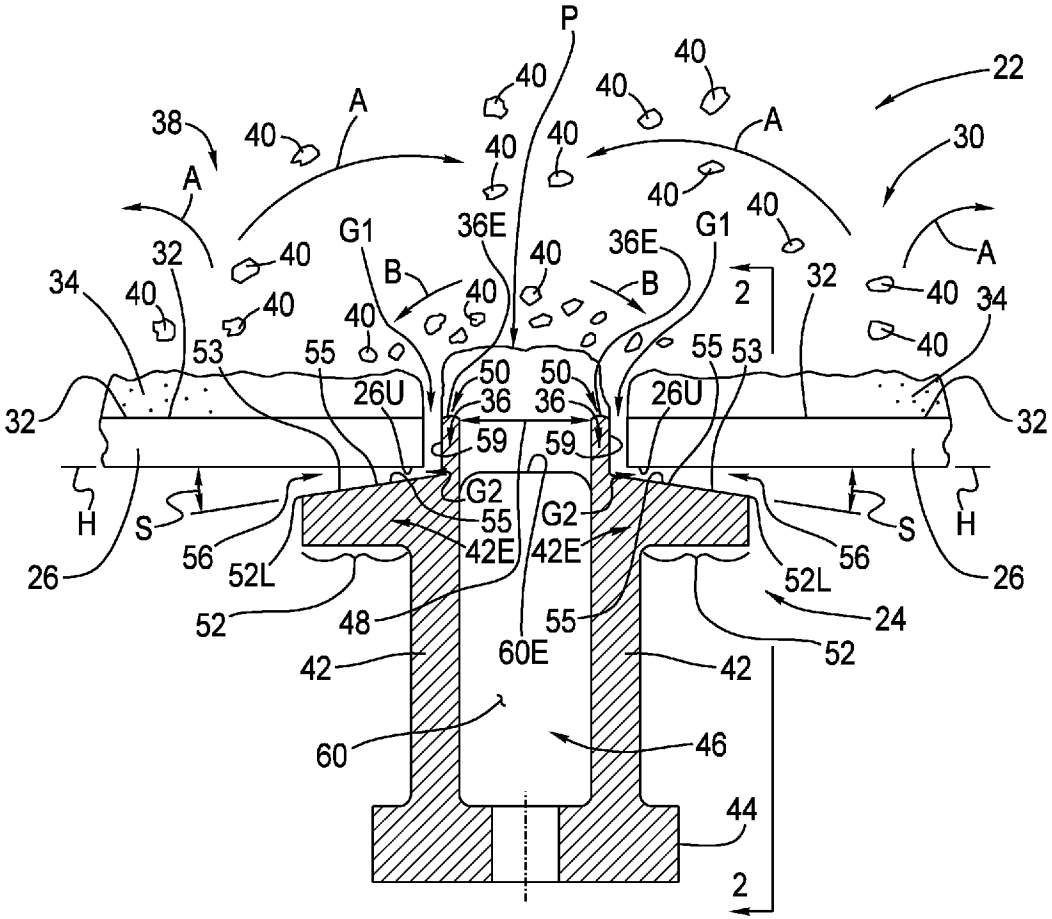
FIG. 2 is a cross sectional view of a seal for a traveling grate stoker.

As shown in FIGS. 1 and 2, the traveling grate stoker 18 includes a seal 22 defined by a stationary seal portion 24 which sealingly cooperates with a plurality of plate assemblies 26 as the plate assemblies successively travel over the stationary seal portion. In one embodiment, each of the plate assemblies 26 include end key plates (not shown) with a plurality of grate bars 30 disposed therebetween. The grate bars 30 and the end key plates cooperate with each other to define conveying surfaces 32 for conveying a fuel 34 disposed thereon, such as coal or biomass, into the interior area 12 of the boiler 10 for combustion. The grate bars 30 communicate with a drive mechanism 29, such as a chain conveyor, for movement of the plate assemblies 26 and fuel 34 through the interior area 12 in a travel direction T. As will be explained below in greater detail, during operation, the plate assemblies 26 travel over the stationary seal portion 24. As shown in FIG. 2, the stationary seal portion 24 and the plate assemblies 26 define gaps G1 and G2 therebetween.

During operation, the fuel 34 is combusted on the conveying surfaces 32 in an oxygen rich area 38 of the interior area 18 of the boiler 10, located generally above the conveying surface. The combustion process creates byproducts 40, such as ash and other abrasive materials, some of which can accumulate on the stationary seal portion 24 adjacent to the gap G1. As described below, the seal 22 has utility in mitigating the introduction of the byproducts 40 into the gaps G1 and G2 and between the stationary seal portion 24 and the plate assemblies 26, reducing wear and thereby prolonging the life of the seal.

Figure 3:
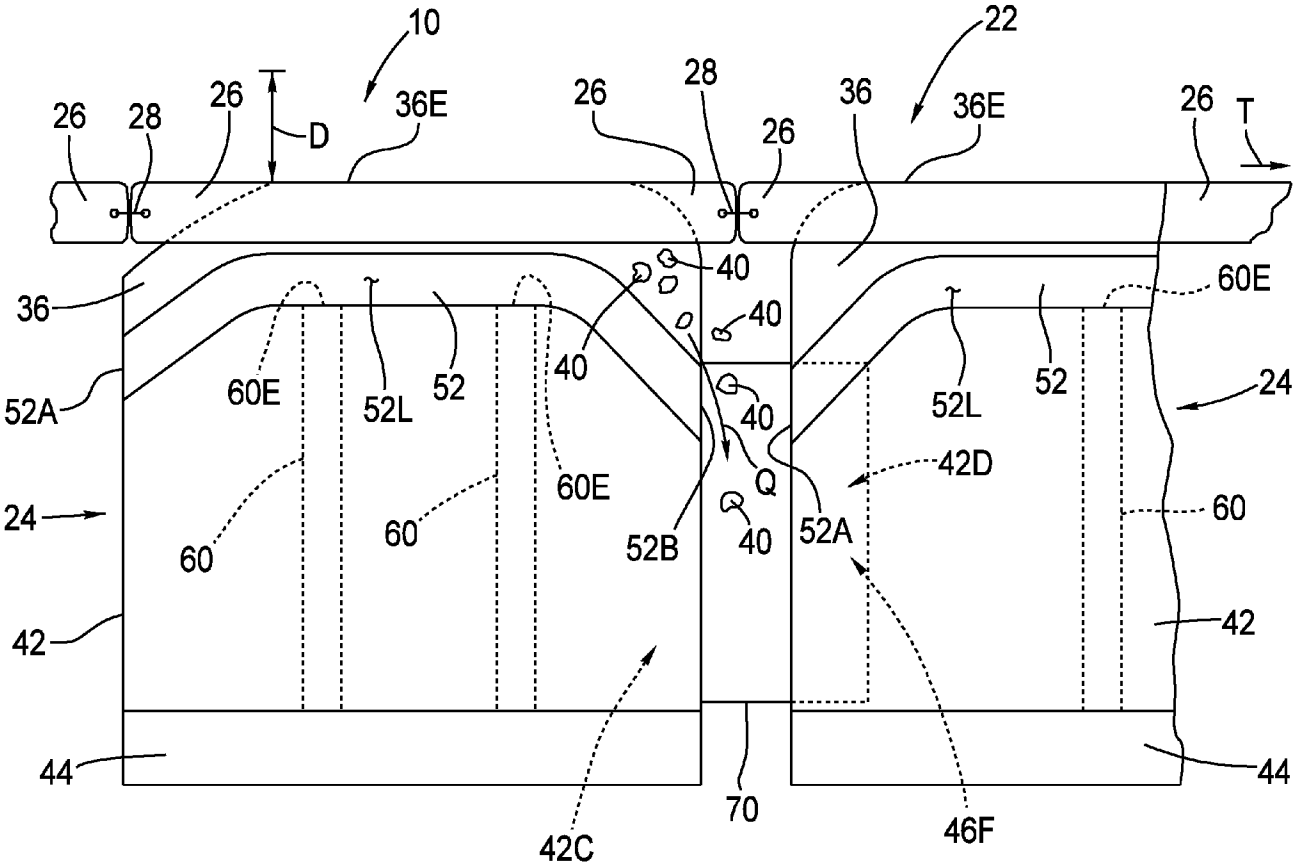
FIG. 3 is a side view of two of the seals of FIG. 2.

Referring to FIGS. 2 and 3, the stationary seal portion 24 is defined by two generally parallel legs 42 and an integral base portion 44. The stationary seal portion 24 is secured to the stationary base by suitable fasteners (not shown) communicating with the base portion 44. The legs 42 and the base portion 44 collectively define a channel 46 therebetween. The channel 46 has a generally U-shaped configuration and terminates at an opening 48 between free ends 50 of the legs 42. The channel 46 can be of any suitable size or shape. The legs 42, while being shown and described as being integral with the base 44, are not limited in this regard as the legs can also be secured to the base and/or another stationary element by suitable fasteners, welding or a combination thereof. Although the legs 42 are shown and described as being parallel, the illustrated embodiment is not limited in this regard as any number of legs, of any configuration can be employed including but not limited to curvilinear legs and more than two legs.

Each of the legs 42 includes a flange 52 extending outwardly from a distal end 42E of each leg. Each of the flanges 52 define a surface 53 extending from the respective leg 42 to a lateral edge 52L and extending between leading 52A and trailing edges 52B (i.e., distal edges or distal ends) of the flange 52. The lateral edge 52L is generally parallel to the leg 42; and the leading 52A and trailing 52B edges are generally perpendicular to the lateral edge 52L. Each of the surfaces 53 include a sealing portion 55 positioned adjacent to the leg 42. The surface 53 and in particular the sealing portion 55 of the flange 52 is positioned in close proximity to an underside 26U of the plate assemblies 26 to seal the gap G2 therebetween.

Each of the legs 42 includes an extension 36 projecting upwardly from the distal end 42E of each leg and having an edge 36E that is approximately flush with the conveying surface 32 of the traveling grate 18. The extensions 36 includes an outwardly facing side portion which defines a sealing surface 59 which is generally parallel to and positioned in close proximity to an edge 26E of each of the plurality of plate assemblies 26 to seal the gap G1 therebetween. As explained further below, the extension 36 serves as a dam to prevent the combustion byproducts 40 from migrating laterally into the gap G2, from the channel 46. In one embodiment, the sealing portion 55 of the surface 53 of the flange 42 is positioned adjacent to the extension 36.

The surface 53 of the flange 52 is sloped downwardly from a junction between the sealing portion 55 and the extension 36 at an angle S of about eight degrees with respect to a horizontal reference line H. Such a configuration defines a progressively increasing opening 56 between the flange 52 and the underside 26 U of each of the plate assemblies 26. The opening 56 defines an outlet or side-discharge portion for discharge of the byproducts 40 which may have been introduced into the opening through the gaps G1 and G2. The slope of the flange 52 facilitates gravity forced movement and/or self cleaning of the byproducts 40 off the flange and out of the opening. Removal of the byproducts 40 from the flange 26 reduces wear and extends the life of the seal. Although the upwardly facing surface 53 is shown in the illustrated embodiment at an angle sloped downwardly eight degrees from the horizontal, the slope is not limited in this regard as other configurations including but not limited to any downwardly sloped angle, surfaces having multiple slopes, portions being horizontal, portions having curved surfaces and combinations thereof can be employed without departing from the broader aspects disclosed herein.

Referring to FIG. 3, a peripheral portion of the surface 53 of the flange 52 is downwardly curved to the leading 52A and the trailing 52B edges of each of the flanges 52. The downward curvature creates a gravity driven path Q (i.e., end-discharge portion) for discharge or self cleaning of the byproducts 40 away from the bearing surface 55. In addition, carryover of the byproducts 40 from one flange 52 to an adjacent downstream flange and seal 22 is mitigated, thereby reducing the potential for wear of the seal. Although the curvature of the peripheral portion of the flange 52 is described and shown in FIG. 3, the magnitude of the curvature shown in FIG. 3 is exemplary and not meant to limit the invention in any way, thus curvatures of any magnitude may be employed. While the peripheral portion of the surface 53 of the flange 52 is shown and described as being downwardly curved towards both the leading 52A and the trailing 52B edges, other embodiments can be employed including but not limited to the peripheral portion of the surface 53 being curved and/or linearly sloped downwardly to only one of the leading 52A and the trailing 52B edges, while the other end is horizontal.

Referring to FIGS. 2 and 3, each of the stationary seal portions 24 include two gusset members 60 disposed in the channel 46 and integral with the legs 42 and base 44. Each of the gusset members 60 extends from the base 44 to a distal end 60E positioned below a conveying surface 32 of the traveling grate 18 and serves as a support member between the legs 42. Prior to operation, the channel 46 is filled with sand for insulating purposes. The gussets members 60 create local dams to maintain the sand in and serve to stiffen the channel 46. While the stationary seal portions 24 are shown and described as having two gusset members 60 it is contemplated that any number of gusset members can be employed. Although the gusset members are shown and described as being integral with the legs 42 and base 44, the present embodiment is not limited in this regard as separate gusset members can be employed and installed with fasteners and/or by welding. While the gusset members are shown and described as extending from the base 44 to a distal end 60E positioned below a conveying surface 32 of the traveling grate, the present invention is not limited in this regard as gusset members of other lengths can be employed including but not limited to those which protrude out of the channel 46 beyond the extensions 36 and those which are about flush with the conveying surface 32.

During operation, the byproducts 40 swirl around in the interior area 12 in multiple directions A. A portion of the byproducts 40 settles on top of the sand in channel 46 and between the extensions 36. After a period of operation, as a result of a damming action by the extensions 36, the byproducts 40 form a pile P above the channel 46 and the conveying surface 32. After a further period of operation, the byproducts 40 fall off the pile P as shown by arrow B, onto the plate assemblies 26, which carry the byproducts away from the gaps G1. Because the extensions 36 provide a dam or barrier mitigating lateral movement of the byproducts 40 into the gaps G1 and G2, the pile P protrudes above the conveying surface 32 and the byproducts 40 fall onto and are carried away by the plate assemblies 26. Therefore, migration of the byproducts 40 into the seal 22 is mitigated. Reducing the migration of the byproducts 40 into the seal 22 reduces wear and increases life of the seal.

Figure 4:
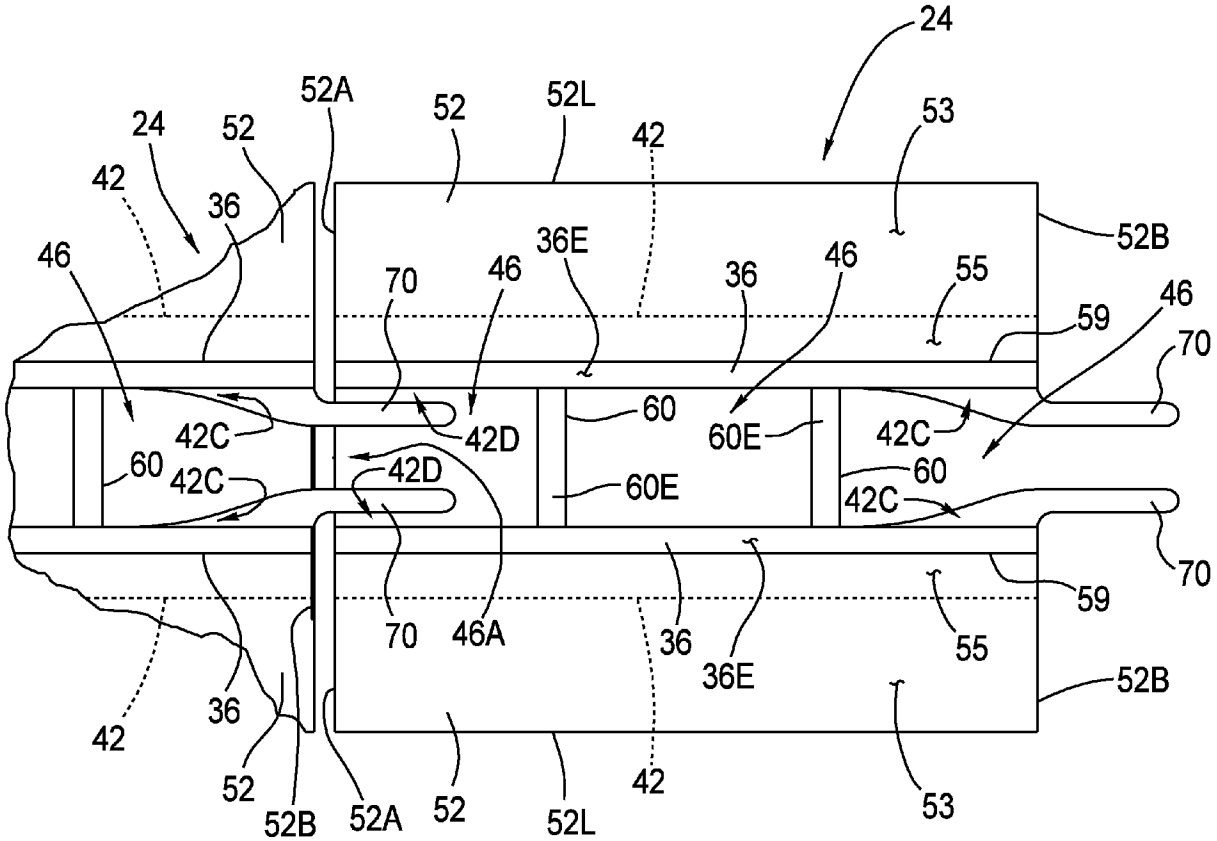
FIG. 4 is a top view of portions of two of the stationary seal portions of FIG. 2.

Referring to FIGS. 3 and 4, a male connector 70 extends laterally from and is integral with an inside portion 42C of each leg 42. When two of the stationary seal portions 24 are assembled with one another, each of the male connectors 70 protrude into a female mating portion 46F defined by opposing inside portions 42D of each leg 42. The male connectors 70 and female mating portions 46F are sized to accommodate thermal expansion of the stationary seal portions 24. Use of the stationary seal portions 24 with the integral male connectors reduces manufacturing costs and facilitates assembly. While the stationary seal portions 24 are shown and described as having two male connectors 70, it is contemplated that the any number of connectors located on inner, outer and/or bottom surfaces of the stationary seal portions can be employed.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A sealing apparatus for use with a traveling grate comprising:

a base; at least one leg extending upwardly from said base; at least one flange extending outwardly from said at least one leg, with the at least one flange defining a surface extending between said at least one leg and at least one edge of said at least one flange, said surface comprising: a sealing portion adjacent to said at least one leg, and at least one self-cleaning discharge portion sloped downwardly from said sealing portion to said at least one edge, for discharge of wear materials therefrom, and said sealing portion stationarily positioned proximate to a portion of the traveling grate and defining a first gap therebetween, said first gap configured for stationary positioning of said sealing portion to mitigate flow therethrough, wherein said portion of the traveling grate travels over said stationary sealing portion.

2. The sealing apparatus of claim 1, wherein said at least one edge comprises a lateral edge generally parallel to said at least one leg and extending between opposing distal ends of said flange; and said at least one self-cleaning discharge portion comprises a side-discharge portion sloped downwardly from said sealing portion to said lateral edge.

3. The sealing apparatus of claim 1, wherein said at least one edge comprises a lateral edge generally parallel to said at least one leg and extending between opposing distal ends of said flange; and said at least one self-cleaning discharge portion comprises an end-discharge portion sloped downwardly from said sealing portion to one of said distal ends.

4. The sealing apparatus of claim 3, wherein said at least one self-cleaning discharge portion comprises a second end-discharge portion sloped downwardly from said sealing portion to another of said distal ends.

5. The sealing apparatus of claim 1, comprising at least one gusset member disposed between said at least one leg and said base.

6. The sealing apparatus of claim 1, wherein each of said at least one legs comprises an extension projecting from an end thereof, each of said extensions defining an outwardly facing side sealing surface, each of said side sealing surfaces positioned proximate to an edge of said traveling grate and defining a second gap therebetween, and said second gap configured for stationary positioning of said sealing portion to mitigate flow therethrough.

7. The sealing apparatus of claim 1, wherein said portion of the traveling grate comprises an upwardly facing conveying surface and each of said at least one legs comprises an extension projecting from an end thereof, said extension having an edge which is approximately flush with said conveying surface.

8. The sealing apparatus of claim 1, comprising at least one male connector extending laterally from said at least one leg.

9. The sealing apparatus of claim 8, wherein said at least one male connector is integral with said at least one leg.

10. The sealing apparatus of claim 1, wherein said at least one leg comprises a first and a second leg which cooperate with said base to form a U-shaped channel, and wherein one of said flanges extends outwardly from each of said first and second legs and at least one gusset member is disposed in said channel.

11. The sealing apparatus of claim 1, wherein the sealing portion is stationary relative to the traveling grate.

12. A sealing apparatus for use with a traveling grate comprising:

a base; a first leg and a second leg extending upwardly from said base, said base and said first and second legs cooperating to form a U-shaped channel; at least one gusset member disposed in said channel; at least one male connector extending laterally from said channel; a first flange extending outwardly from said first leg and defining a first surface extending between said first leg and at least one edge of said first flange; a second flange extending outwardly from said second leg defining a second surface extending between said second leg and at least one edge of said second flange; said first surface comprising a first sealing portion adjacent to said first leg and at least one first self-cleaning discharge portion sloped downwardly from said first sealing portion to said at least one edge of said first flange, for discharge of wear materials therefrom; said second surface comprising a second sealing portion adjacent to said second leg and at least one second self-cleaning discharge portion sloped downwardly from said second sealing portion to said at least one edge of said second flange, for discharge of wear materials therefrom; and said first and second sealing portions are positioned proximate to portions of the traveling grate and defining gaps therebetween, said gaps configured for stationary positioning of said sealing portion therein to mitigate flow therethrough, wherein said portion of the traveling grate travels over said stationary sealing portion.

13. The sealing apparatus of claim 12, wherein the first sealing portion and second sealing portion are stationary relative to the traveling grate.

* * * * *